US008342250B2

(12) United States Patent
Blair et al.

(10) Patent No.: US 8,342,250 B2
(45) Date of Patent: Jan. 1, 2013

(54) METHODS AND APPARATUS FOR MANIPULATING AND DRIVING CASING

(75) Inventors: Steven G. Blair, Tomball, TX (US); Brent J. Fendley, Cypress, TX (US); Adam Richard Williams, Conroe, TX (US); John G. Evans, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/869,479

(22) Filed: Aug. 26, 2010

(65) Prior Publication Data

US 2011/0048739 A1 Mar. 3, 2011

Related U.S. Application Data

(60) Provisional application No. 61/237,572, filed on Aug. 27, 2009.

(51) Int. Cl.
*E21B 19/18* (2006.01)
*E21B 19/16* (2006.01)

(52) U.S. Cl. ..... 166/380; 166/77.51; 166/77.53

(58) Field of Classification Search ..... 166/120, 166/207, 387, 380, 77.53, 85.1, 77.51; 175/258, 175/260, 261
See application file for complete search history.

(56) References Cited

U.S. PATENT DOCUMENTS

| | | | | |
|---|---|---|---|---|
| 2,671,514 | A * | 3/1954 | Haines | 166/119 |
| 3,283,824 | A * | 11/1966 | Hoffman et al. | 166/212 |
| 3,412,800 | A * | 11/1968 | Kisling, III | 166/120 |
| 3,727,967 | A | 4/1973 | Anastasiu et al. | |
| 5,045,832 | A | 9/1991 | Tam | |
| 5,265,937 | A | 11/1993 | Allen | |
| 5,623,991 | A | 4/1997 | Jani | |
| 5,771,970 | A | 6/1998 | Jani | |
| 5,971,079 | A * | 10/1999 | Mullins | 166/387 |
| 6,062,309 | A | 5/2000 | Gosse | |
| 6,155,346 | A | 12/2000 | Aldridge | |
| 6,199,641 | B1 | 3/2001 | Downie et al. | |
| 6,227,306 | B1 | 5/2001 | Downie et al. | |
| 6,309,002 | B1 | 10/2001 | Bouligny | |
| 6,311,792 | B1 | 11/2001 | Scott et al. | |

(Continued)

FOREIGN PATENT DOCUMENTS

JP 09060468 3/1997

(Continued)

OTHER PUBLICATIONS

International Search Report for International Application No. PCT/US2010/046844 mailed Apr. 15, 2011, 10 pages.

(Continued)

*Primary Examiner* — Daniel P Stephenson
*Assistant Examiner* — Michael Wills, III
(74) *Attorney, Agent, or Firm* — Steve Rosenblatt

(57) ABSTRACT

An apparatus and methods for manipulating and driving casing. The apparatus includes mechanically responsive elements for gripping an interior of a casing joint, and hydraulically responsive elements for gripping an interior of the casing joint responsive to pressure of drilling fluid flowing through the apparatus. One method comprises manipulating a casing joint by mechanically gripping an interior thereof, hydraulically gripping the interior of the casing joint responsive to drilling fluid pressure, and rotating the casing joint. Another method comprises driving casing by applying weight and torque thereto through engagement with an interior thereof.

16 Claims, 3 Drawing Sheets

U.S. PATENT DOCUMENTS

| | | | | |
|---|---|---|---|---|
| 6,318,459 | B1 | 11/2001 | Wright et al. | |
| 6,536,520 | B1 | 3/2003 | Snider et al. | |
| 6,550,540 | B2 | 4/2003 | Trent | |
| 6,688,394 | B1 | 2/2004 | Ayling | |
| 6,688,398 | B2 | 2/2004 | Pietras | |
| 6,705,413 | B1 | 3/2004 | Tessari | |
| 6,725,938 | B1 | 4/2004 | Pietras | |
| 6,732,822 | B2 * | 5/2004 | Slack et al. | 175/423 |
| 6,742,584 | B1 | 6/2004 | Appleton | |
| 7,021,374 | B2 | 4/2006 | Pietras | |
| 7,021,382 | B2 | 4/2006 | Angman et al. | |
| 7,044,241 | B2 | 5/2006 | Angman | |
| 7,077,205 | B2 | 7/2006 | Eddison | |
| 7,107,875 | B2 * | 9/2006 | Haugen et al. | 81/57.15 |
| 7,117,957 | B2 | 10/2006 | Metcalfe et al. | |
| 7,121,350 | B2 | 10/2006 | Aldridge et al. | |
| 7,137,454 | B2 | 11/2006 | Pietras | |
| 7,140,443 | B2 | 11/2006 | Beierbach et al. | |
| 7,140,445 | B2 | 11/2006 | Shahin et al. | |
| 7,165,609 | B2 * | 1/2007 | Slack et al. | 166/77.1 |
| 7,191,840 | B2 | 3/2007 | Pietras et al. | |
| 7,219,744 | B2 | 5/2007 | Pietras | |
| 7,325,610 | B2 | 2/2008 | Giroux et al. | |
| 7,334,650 | B2 | 2/2008 | Giroux et al. | |
| 7,360,594 | B2 * | 4/2008 | Giroux et al. | 166/242.6 |
| 7,370,707 | B2 | 5/2008 | McDaniel et al. | |
| 7,377,324 | B2 * | 5/2008 | Beierbach et al. | 166/380 |
| 7,475,742 | B2 | 1/2009 | Angman et al. | |
| 7,513,300 | B2 | 4/2009 | Pietras et al. | |
| 7,624,820 | B2 | 12/2009 | Angman et al. | |
| 7,647,990 | B2 | 1/2010 | Tessari et al. | |
| 7,654,325 | B2 | 2/2010 | Giroux et al. | |
| 7,654,334 | B2 | 2/2010 | Manson | |
| 7,673,675 | B2 | 3/2010 | Carr et al. | |
| 7,681,649 | B2 | 3/2010 | Cerovsek | |
| 7,694,730 | B2 | 4/2010 | Angman | |
| 7,712,523 | B2 | 5/2010 | Snider et al. | |
| 7,757,754 | B2 | 7/2010 | McKay | |
| 7,770,635 | B2 | 8/2010 | Angman | |
| 7,784,551 | B2 * | 8/2010 | Angman et al. | 166/382 |
| 7,874,352 | B2 * | 1/2011 | Odell et al. | 166/77.51 |
| 7,896,111 | B2 * | 3/2011 | Slack | 175/423 |
| 7,909,120 | B2 * | 3/2011 | Slack | 175/423 |
| 2002/0170720 | A1 | 11/2002 | Haugen | |
| 2004/0216892 | A1 * | 11/2004 | Giroux et al. | 166/380 |
| 2005/0000691 | A1 * | 1/2005 | Giroux et al. | 166/291 |
| 2005/0269105 | A1 | 12/2005 | Pietras | |
| 2007/0074876 | A1 | 4/2007 | Pietras | |
| 2007/0131416 | A1 | 6/2007 | Odell, II et al. | |
| 2007/0193751 | A1 * | 8/2007 | Pietras et al. | 166/380 |
| 2008/0083540 | A1 * | 4/2008 | Haugen | 166/380 |
| 2008/0210439 | A1 | 9/2008 | Angman et al. | |
| 2008/0302525 | A1 * | 12/2008 | Beierbach et al. | 166/85.1 |
| 2009/0101332 | A1 | 4/2009 | Shahin et al. | |
| 2009/0120649 | A1 | 5/2009 | Cerovsek | |
| 2009/0126936 | A1 | 5/2009 | Begley et al. | |
| 2009/0126941 | A1 | 5/2009 | Laitolais, Jr. et al. | |
| 2009/0136326 | A1 | 5/2009 | Angman | |
| 2009/0242192 | A1 | 10/2009 | Jensen et al. | |
| 2009/0272543 | A1 * | 11/2009 | Bouligny et al. | 166/381 |
| 2009/0314496 | A1 * | 12/2009 | Begnaud et al. | 166/380 |
| 2009/0321086 | A1 | 12/2009 | Zimmermann | |
| 2010/0139978 | A9 * | 6/2010 | Giroux et al. | 175/57 |
| 2010/0155052 | A1 | 6/2010 | Manson | |

FOREIGN PATENT DOCUMENTS

| | | |
|---|---|---|
| JP | 2009018214 | 1/2009 |
| WO | 2007019594 | 2/2007 |

OTHER PUBLICATIONS

International Written Opinion for International Application No. PCT/US2010/046844 mailed Apr. 15, 2011, 4 pages.

Tesco, Casing Drive System, Bulletin 41000e, www.tescocorp.com Jun. 2005, 4 pages.

Baker Hughes Incorporated, Technical Unit 4614, Type D Casing Spear, Product Family No. H12009, Oct. 2010, 2 pages.

Baker Hughes Incorporated, Technical Unit 4607, Type B Casing Spear, Product Family No. H12609, Nov. 2010, 2 pages.

Baker Hughes Incorporated, Technical Unit 4160, Model B-2 and B-3 Tubing Anchor Catcher, Product Family Nos. H69803 and H69804, Oct. 2003, 3 pages.

* cited by examiner

METHODS AND APPARATUS FOR MANIPULATING AND DRIVING CASING

CROSS-REFERENCE TO RELATED APPLICATION

This application claims the benefit of U.S. Provisional Patent Application Ser. No. 61/237,572 entitled "METHODS AND APPARATUS FOR MANIPULATING AND DRIVING CASING," filed Aug. 27, 2009, the disclosure of which is incorporated herein in its entirety by this reference.

TECHNICAL FIELD

Embodiments of the present invention relate to manipulating casing for subterranean well bores. More particularly, embodiments of the present invention relate to methods and apparatus for gripping and rotating casing by the interior thereof from the earth's surface, which methods and apparatus may be employed to drill or ream with casing.

BACKGROUND

It is known in the art of subterranean drilling to use a so-called "top drive" to connect a section, also known as a "joint," of well bore casing above a drilling rig floor to the upper end of a casing string substantially disposed in the well bore. Such casing strings, commonly termed "surface casing," may be set into the well bore as much as 3,000 feet (914.4 meters), and typically about 1,500 feet (457.2 meters), from the surface.

Examples of methods and apparatus for making casing joint connections to a casing string are disclosed in U.S. Pat. Nos. 6,742,584 and 7,137,454, the disclosure of each of which patents is incorporated herein by this reference.

It is known in the art of subterranean drilling to drill and ream with casing, using a drilling or reaming shoe including a cutting structure thereon to drill a well bore, or to ream an existing well bore to a larger diameter, to remove irregularities in the well bore, or both. It would be highly desirable for the subterranean drilling industry to employ a top drive to apply weight on the casing in combination with casing rotation to drill or ream with casing using a drilling or reaming device at the distal end of the casing string.

BRIEF SUMMARY

In one embodiment, the present invention comprises a casing assembly having a longitudinal passage therethrough in communication with a plurality of circumferentially spaced, radially movable pistons and extending to at least one outlet of the lower end of the assembly, a plurality of selectively mechanically actuable, radially movable slips, a plurality of spring-biased friction blocks longitudinally spaced from the slips, a downward-facing packer cup positioned between the slips and the at least one outlet, and a tapered stabilizer guide below the downward-facing packer cup.

In another embodiment, the present invention comprises a method of manipulating casing comprising inserting an assembly into an upper end of a casing joint, gripping the casing joint by an interior thereof with the assembly responsive to longitudinal movement of one portion of the assembly with respect to another portion of the assembly, pumping drilling fluid through the assembly to cause the assembly to grip the interior of the casing joint responsive to hydraulic pressure of the drilling fluid, preventing drilling fluid from exiting the upper end of the casing joint, and rotating the casing joint.

Another embodiment comprises a method of driving casing, including engaging an uppermost casing joint of a casing string having a device with a cutting structure thereon at a lower end thereof substantially only on an interior of the uppermost casing joint, rotating the casing string by application of torque to the interior of the uppermost casing joint and applying weight to the casing string during rotation thereof.

DETAILED DESCRIPTION

The illustrations presented herein are not actual views of any particular drilling system, assembly, or device, but are merely idealized representations which are employed to describe embodiments of the present invention.

While embodiments of the present invention are described herein with respect to manipulation of, and drilling with, casing, it is also contemplated that an appropriately sized drive assembly may be used to engage, rotate, and apply weight for drilling with any suitable tubular goods having sufficient longitudinal compressive and torsional (shear) strength to withstand application of longitudinal force and torque for drilling. Accordingly, as used herein, the term "casing" means and includes not only convention casing casing joints but also liner joints, drill pipe joints, and drill collar joints. In addition, multiple-joint assemblies, termed "stands," of any and all of the foregoing tubular goods may be used with, and manipulated by, embodiments of the apparatus of the present invention.

As used herein, the terms "upper," "lower," "above," and "below," are used for the sake of clarity in a relative sense as an embodiment of the casing drive assembly is oriented during use to manipulate and drive a casing joint or string.

Figure 1A:
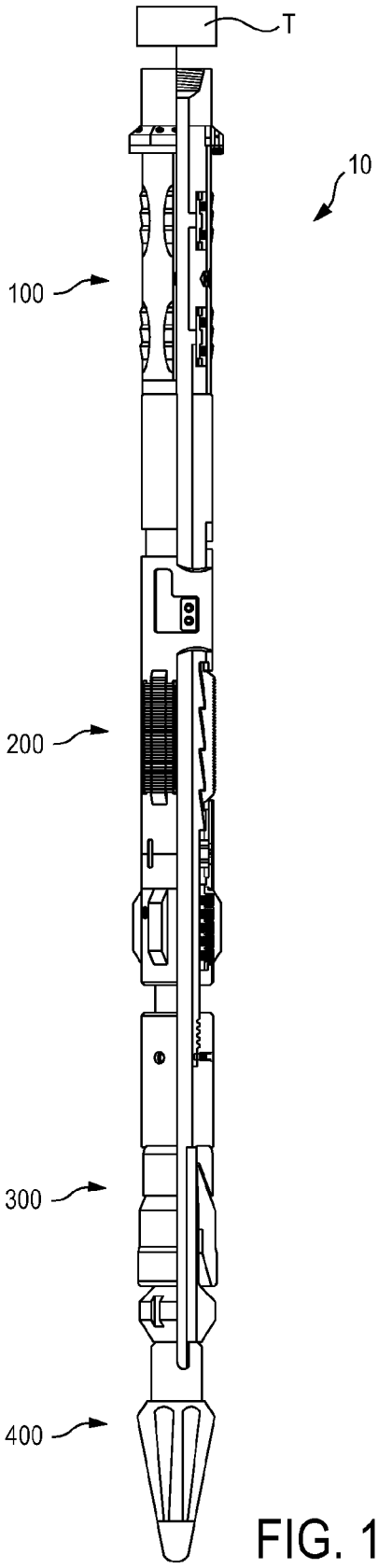
FIG. 1A is a partial sectional elevation of a casing drive assembly according to an embodiment of the present invention.

Referring to FIG. 1A of the drawings, an embodiment of a casing drive assembly 10 according to the present invention comprises, from an upper to a lower end thereof, a top drive T a hydraulic anchor 100, a mechanical casing spear 200, a cup type packer 300, and a tapered stabilizer 400.

Figure 1B:
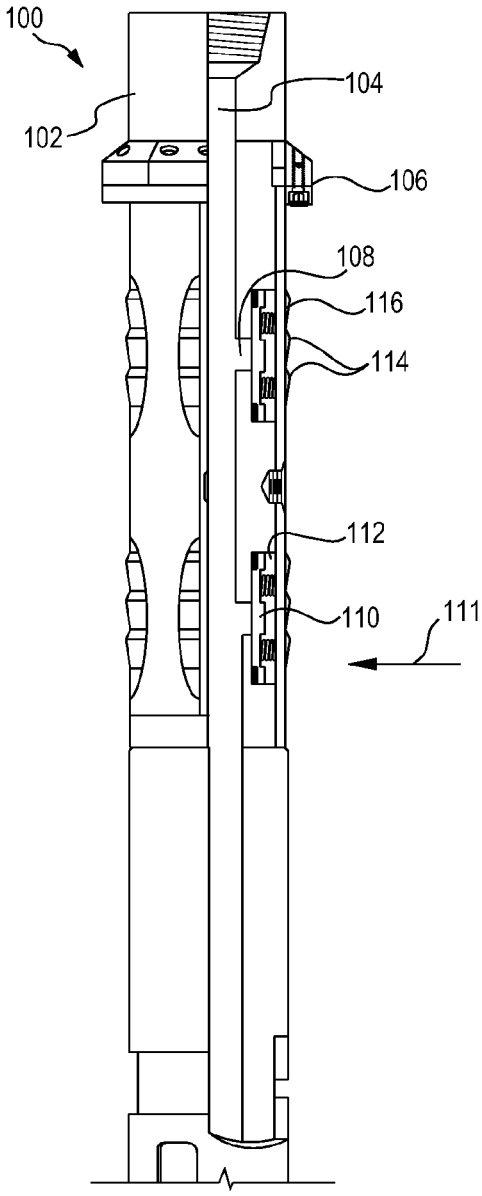
FIG. 1B is a detail view of FIG. 1A showing a hydraulic anchor of the casing drive assembly.

As shown in FIG. 1B, the hydraulic anchor 100 comprises a housing 102 having a circumferential stop collar 106 about the upper end thereof for limiting insertion of the casing drive assembly 10 into a casing joint. The housing 102 includes a longitudinal passage 104 extending therethrough from top to bottom, in communication with lateral passages 108 extending to the interiors of spring-loaded, inwardly biased pistons 110 in two longitudinally separated groups, each group comprising a plurality of pistons 110 (in this instance, four) equally circumferentially spaced in pockets 112 in the housing 102. The direction of inward bias with springs is illustrated schematically as arrow 111 to indicate springs within the housing 102 and pushing to retract the pistons 110 in the direction of arrow 111. Seals (not shown) enable fluid-tight movement of the pistons 110 in the pockets 112 responsive to a drilling fluid pressure within the longitudinal passage 104. The pistons 110 comprise gripping structures 114 on exterior surfaces 116 thereof, as is conventional in the art. Such gripping structures 114 may comprise, by way of non-limiting example, machined teeth, crushed tungsten carbide, tungsten carbide inserts in the form of bricks, buttons or discs, superabrasive elements such as natural or polycrystalline diamond, or a combination thereof. In one embodiment, gripping structures comprise carbide inserts configured with teeth.

Figure 1C:
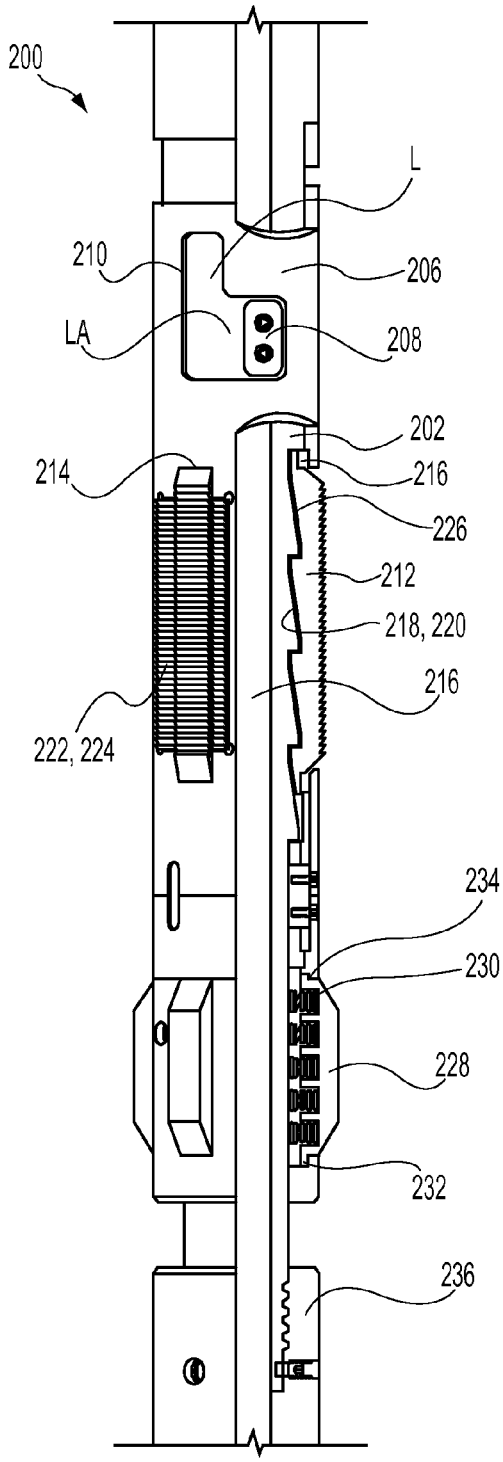
FIG. 1C is a detail view FIG. 1A showing a mechanical spacing spear of the casing drive assembly.

Secured to the lower end of the hydraulic anchor 100 is the casing spear 200, which may be configured substantially as a Baker Oil Tools (Tri-State) Type "D" Casing Spear. As shown in FIG. 1C, the casing spear 200 comprises a mandrel 202 having a longitudinal passage 204 extending therethrough and in communication with the longitudinal passage 104 of the hydraulic anchor 100. An outer housing 206 is longitudinally slidably and rotationally disposed over the mandrel 202, longitudinal movement of the outer housing 206 being constrained by engagement of a lug 208 protruding radially from the mandrel 202 through a J-slot 210 having a longitudinally extending segment L and a laterally extending segment LA, the lug 208 extending through the wall of outer housing 206. A plurality of slips 212 is disposed in a like plurality of slots 214 extending through the outer housing 206. The slips 212 include lips 216 at longitudinally upper and lower ends thereof to retain the slips 212 within the slots 214. The interior of the slips 212 comprise a plurality of stepped wedge elements 218 having concave, partial frustoconical radially inner surfaces 220. The outer surfaces 222 of the slips 212 comprise gripping structures 224, as is conventional in the art. Such gripping structures 224 may comprise, by way of non-limiting example, machined teeth, crushed tungsten carbide, tungsten carbide inserts in the form of bricks, buttons or discs, superabrasive elements such as natural or polycrystalline diamond, or a combination thereof. In one embodiment, gripping structures comprise tungsten carbide inserts in the form of buttons having four projecting, pyramidal points. Two longitudinally extending groups of eight to ten buttons per slip 212 may be employed.

Inner surfaces 220 of stepped wedge elements 218 are sized and configured to cooperate with stepped convex, frustoconical wedge surfaces 226 on an exterior surface of the mandrel 202 to move the slips 212 radially outwardly responsive to upward movement of the mandrel 202 within the outer housing 206. A plurality of circumferentially spaced stabilizer friction blocks 228 are radially outwardly biased by springs 230 and are disposed within slots 232 in outer housing 206 and retained therein against the outward spring biased by lips 234 at upper and lower ends of the stabilizer friction blocks 228. A lower housing 236 is secured to the lower end of the mandrel 202.

Figure 1D:
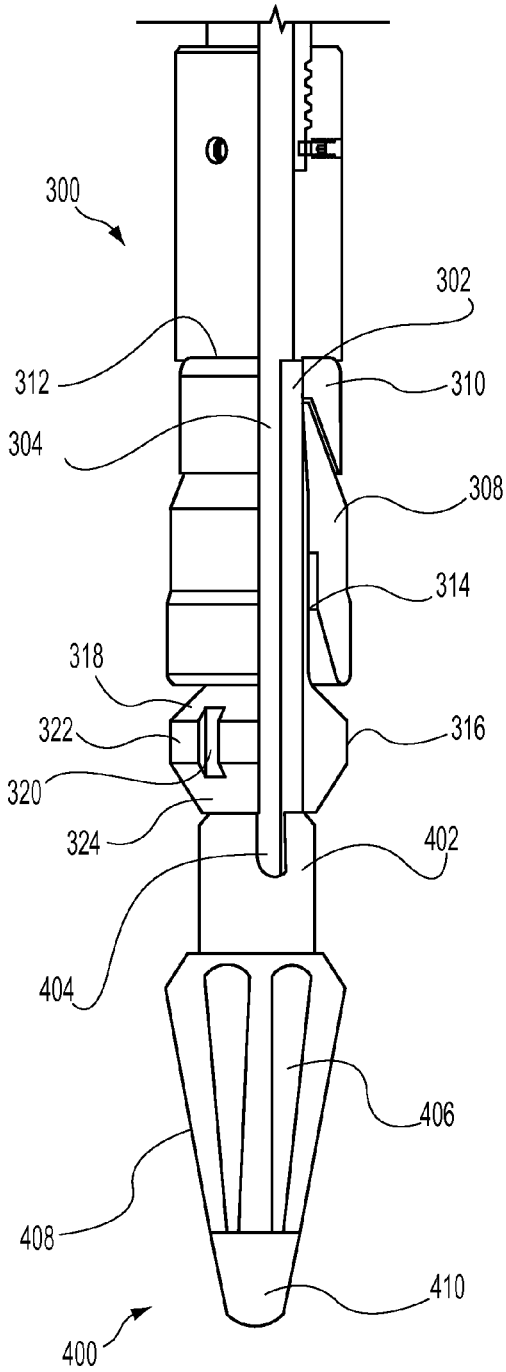
FIG. 1D is a detail view of FIG. 1A showing a cup type packer and a tapered stabilizer of the casing drive assembly.
Figure 2:
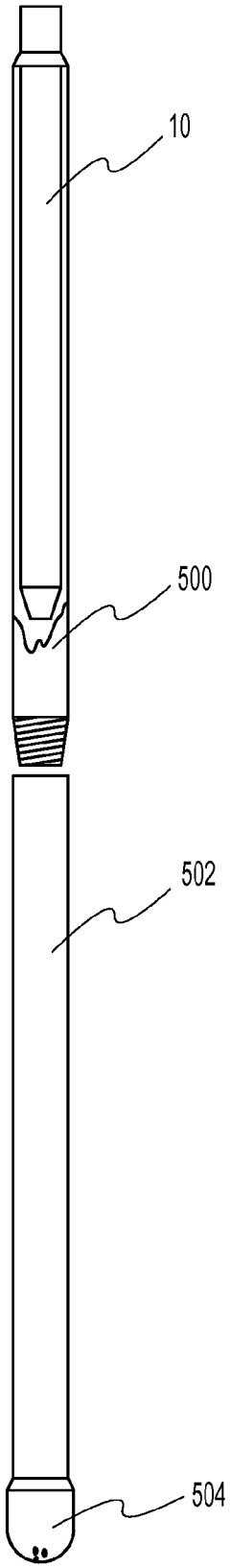
FIG. 2 is a schematic of a casing drive assembly, such as shown in FIG. 1A, disposed within a casing joint of a casing string above another casing joint.

Secured to the lower housing 236 of the casing spear 200 at the lower end thereof is a packer mandrel 302 of the cup-type packer 300, as shown in FIG. 1D, the cup-type packer 300 having a longitudinal passage 304 therethrough in communication with the longitudinal passage 204 of casing spear 200. A downward-facing, elastomeric, wire mesh-reinforced annular packer cup 308 is disposed over the upper mandrel 302 and retained thereon between an annular support wedge 310 abutting a downward-facing annular shoulder 312 and the upper end of a guide sleeve 314, from which an annular, radially projecting casing guide 316 projects. The casing guide 316 comprises frustoconical upper and lower surfaces 318, 320 longitudinally separated by a cylindrical guide surface 322, circumferentially spaced, longitudinally extending slots 324 communicating between the upper and lower surfaces 318, 320.

As further shown in FIG. 1D, the tapered stabilizer 400 is secured at its upper end 402 to the lower end of the packer mandrel 302, and includes a longitudinal passage 404 in communication with the longitudinal passage 304 of the cup-type packer 300. The longitudinal passage 404 extends to, and communicates with, outlet slots 406 extending through an outer surface of a frustoconical, tapered stabilizer guide 408 terminating at a nose 410.

In use, and with reference to drawing FIGS. 1A, 1B, 1C, 1D and 2, wherein a casing joint 500 is shown disposed above another casing joint 502, a single joint of casing 500 is picked up using the rig elevators, as is conventional, and stabbed up into an existing casing joint 502 (if a casing string has already been started). The casing drive assembly 10 is made up with and suspended from a top drive via a slack joint, and lowered by the top drive into the bore of the casing joint 500 from the top thereof. The elevators stay latched and ride down the casing joint 500 during this operation. Once the casing drive assembly 10 has entered casing joint 500 sufficiently so that stop collar 104 arrests further travel of casing drive assembly 10 into the casing joint 500, casing joint 500 is rotated to engage casing joint 502. The casing joint 500 may be run up with the rig tongs or casing drive assembly 10 may be used to transmit rotation to the casing joint 500 once it is fully engaged with casing joint 500, after engagement with the interior of casing joint 500, as described below. The tapered stabilizer guide 408, the casing guide 316 and the spring-biased friction blocks 228 aid insertion and centering of the casing drive assembly 10 into and within the casing joint.

If the casing joint 500 is the first joint in the casing string, a cutting structure, such as a drilling or reaming device, is made up with the lower end thereof prior to insertion of casing drive assembly 10. Non-limiting examples of such devices are, for drilling, the EZ Case™ casing bit and, for reaming, the EZ Ream™ shoe. Otherwise, such a device 504 is already secured to the distal end of the lowermost casing joint in the casing string. To initially engage the casing drive assembly 10 with the interior of casing joint 500, the casing spear 200 is manipulated, as by right-hand (clockwise, looking downward) rotation of the casing drive assembly 10 to move the lug 208 within the laterally extending segment LA of the J-slot 210 and align the lug 208 with the longitudinal segment L of the J-slot 210, followed by application of an upward force to the casing drive assembly 10. The spring-biased friction blocks 228 provide sufficient, initial frictional drag against the interior of the casing joint 500 to maintain the outer housing 206 of the casing spear 200 stationary within the casing joint 500 until the gripping structures 224 on the outer surfaces 222 of the slips 212 engage the interior of the casing joint 500 as the stepped convex, frustoconical wedges surfaces 226 of the mandrel 202 move upwardly with respect to the stepped wedge elements 218 on the interior surfaces 220 of the slips 212 and force the slips 212 radially outwardly to securely grip the interior of the casing joint.

The engaged casing joint 500 is then lifted using the top drive to permit slips of a holding device at the rig floor, commonly termed a "spider," which are employed to suspend the existing casing string below the rig floor, as is conventional.

The rig pump may then be engaged and circulation of drilling fluid established through the casing drive assembly 10 through the longitudinal passages 104, 204, 304 and 404 and out into the interior of the casing joint 500 through the outlet slots 406. Upward circulation of drilling fluid within the casing joint 500 is precluded by the packer cup 308, which expands against and seals with the interior of the casing joint 500 under drilling fluid pressure, a prompt and fluid-tight seal being facilitated by the presence of the slots 324 of the casing guide 316. Drilling fluid pressure is increased until sufficient pressure is observed to cause the pistons 110 of the hydraulic anchor 100 to grip the interior of the casing joint 500.

The casing drive assembly 10, with the casing joint 500 secured thereto by the hydraulic anchor pistons 110, is then rotated by the top drive to rotate the casing joint 500 and any others therebelow (if any) in the casing string, the top drive also providing weight, and drilling or reaming commences. Notably, both torque and weight are applied to the casing joint 500 via engagement of the casing drive assembly 10 substantially only with the interior of the casing joint 500.

The rig elevators remain attached as the casing joint 500 descends until a point just above the rig floor, where they can be reached and released for picking up the next casing joint. When the upper end of the casing joint 500, engaged by the casing drive assembly 10, approaches the rig floor, the slips of the spider are then employed to grip the casing joint 500, drilling fluid circulation ceases, releasing the pistons 110 of the hydraulic anchor 100 from the casing joint under their inward spring-loading, the casing drive assembly 10 is lowered sufficiently to release the slips 210 of the casing spear 200 from the casing joint and rotated slightly to the left (counterclockwise, looking downward) to maintain the release of the slips 212, and the casing drive assembly 10 is withdrawn from the casing joint 500 for subsequent insertion into another casing joint picked up by the rig elevators, the above-described process then being repeated.

A significant advantage of the use of a casing drive assembly according to an embodiment of the present invention is reduced casing thread wear, due to the lack of a threaded connection between the casing drive assembly and the casing joint engaged thereby.

While particular embodiments of the invention have been shown and described, numerous variations and alternate embodiments will occur to those skilled in the art. Accordingly, it is intended that the invention only be limited in terms of the appended claims and their legal equivalents.

What is claimed is:

1. A casing drive assembly, comprising:

a housing further comprising a longitudinal passage therethrough in communication with a plurality of circumferentially spaced, radially movable pistons and extending to at least one outlet of the lower end of the assembly;

said pistons comprising a gripping member having a gripping face selectively engageable with a casing joint in response to pressure in said longitudinal passage applied to a drill bit located at a distal end of a lowermost casing joint for casing drilling therewith;

a drive for selectively moving said housing and one or more casing joints that are engaged to or supported by said radially movable pistons;

a plurality of selectively mechanically actuable, radially movable slips for selective engagement of said casing joint for positioning the joint adjacent another joint for assembly;

a plurality of radially spring-biased friction blocks longitudinally spaced from the slips;

a downward-facing packer cup positioned between the slips and the at least one outlet; and a stabilizer guide below the downward-facing packer cup.

2. The casing drive assembly of claim 1, wherein the plurality of circumferentially spaced, radially movable pistons are inwardly spring-biased and disposed in pockets in a tubular housing through which a portion of the longitudinal passage extends.

3. The casing drive assembly of claim 2, further comprising a stop structure secured to an upper end of the tubular housing.

4. The casing drive assembly of claim 2, wherein the plurality of selectively mechanically actuable, radially movable slips and the plurality of spring-biased friction blocks are carried by another housing, and further comprising a mandrel extending through the another housing and secured to a lower end of the housing, the mandrel comprising structure for radially extending the selectively mechanically actuable, radially movable slips responsive to relative upward movement of the mandrel within the another housing.

5. The casing drive assembly of claim 4, further comprising a J-slot in the another housing through which a lug secured to the mandrel protrudes, the J-slot comprising a longitudinally extending segment and a laterally extending segment.

6. The casing drive assembly of claim 4, further comprising a mandrel bearing the downward-facing packer cup operably coupled to the mandrel extending through the another housing, and an annular, radially projecting casing guide below the downward-facing packer cup.

7. The casing drive assembly of claim 6, wherein the at least one outlet comprises a plurality of outlets located in the tapered stabilizer guide.

8. A tubular drive assembly, comprising:

a housing having a passage therethough;

a gripping assembly on said housing selectively engageable to a tubular for positioning one tubular for connection to another tubular and further comprising a bit on a lowermost of said tubulars;

a seal on said housing between said gripping assembly and a lower end of said passage that engages the tubular to contain pressure delivered through said passage from getting past said seal;

an anchor assembly actuated with internal pressure in said passage on said housing and to said bit for selectively transmitting rotation of said housing to one or more tubulars in contact directly or indirectly to said anchor assembly.

9. The assembly of claim 8, wherein:

said gripping assembly is mechanically set.

10. The assembly of claim 9, wherein:

said gripping assembly further comprises drag blocks and a j-slot mounted to said housing such that manipulation of said housing radially extends said gripping assembly.

11. The assembly of claim 8, wherein:

said anchor assembly is hydraulically set.

12. The assembly of claim 8, wherein:

said seal comprises at least one packer cup oriented to prevent fluid flowing through said passage from reversing direction in an annular space between said housing and the tubular.

13. The assembly of claim 8, wherein:

said housing further comprises at least one centralizer.

14. The assembly of claim 13, wherein:

said housing further comprises a tapered stabilizer adjacent a lower end thereof.

15. The assembly of claim 8, wherein:

said housing further comprises a travel stop to limit advancement of said housing into the tubular for positioning said gripping assembly or said anchor assembly at a predetermined location in the tubular.

16. The assembly of claim 8, further comprising:

a top drive for selective rotation of said housing.

* * * * *